United States Patent [19]

Pothieux et al.

[11] Patent Number: 4,918,268

[45] Date of Patent: Apr. 17, 1990

[54] ARC-ROTATING MAGNETIC BLAST COIL FOR THE CONTACT ELEMENT OF AN ELECTRIC SWITCH

[75] Inventors: Daniel Pothieux, Grieges; Bernard Gallix, Decines Charpieu; Julien Llorens, Le Murgeret, all of France

[73] Assignee: Societe Anonyme dite: Alsthom, Paris, France

[21] Appl. No.: 247,549

[22] Filed: Sep. 22, 1988

[30] Foreign Application Priority Data

Sep. 23, 1987 [FR] France ..... 87 13131

[51] Int. Cl.[4] ..... H01H 33/18

[52] U.S. Cl. ..... 200/147 R

[58] Field of Search ..... 200/147 R, 147 C

[56] References Cited

U.S. PATENT DOCUMENTS 4,052,577 10/1977 Votta ..... 200/147 C 4,259,554 3/1981 Smith et al. ..... 200/147 C 4,329,551 5/1982 Bernard et al. ..... 200/147 C

*Primary Examiner*—Robert S. Macon

*Attorney, Agent, or Firm*—Sughrue, Mion, Zinn, Macpeak & Seas

[57] ABSTRACT

An arc-rotating magnetic blast coil for the contact element of an electric switch, the coil comprising, in particular, a conducting cup (1) which is cylindrical in shape and which is connected to a current inlet (33), a winding (23) disposed inside the cup to produce a magnetic field along the axis of the cup and having one end (14) connected to the cup, a conducting core (7) connected to the other end (12) of the winding and situated in the center of the winding, and a fixed circuit-breaking contact disposed ahead of the coil relative to said cup within the magnetic field produced thereby and electrically connected to said core, characterized in that the winding is constituted by means of a flat conductor (8) comprising a plurality of turns wound on the core together with an insulating sheet, and in that means (16, 9) are provided for putting the winding under compression.

11 Claims, 2 Drawing Sheets

ARC-ROTATING MAGNETIC BLAST COIL FOR THE CONTACT ELEMENT OF AN ELECTRIC SWITCH

The present invention relates to an arc-rotating magnetic blast coil for the contact element of an electric switch, such as a contactor or a circuit breaker. The invention is applicable, in particular, to apparatuses of this type used for medium tensions, in the range 3 kV to 40 kV.

BACKGROUND OF THE INVENTION

Such apparatuses are well known. Some of them are provided with a conducting cup which is generally cylindrical in shape and which is connected to a current inlet, a winding disposed inside said cup in order to produce a magnetic field along the axis of the cup and having one end connected to the cup, conducting core connected to the other end of the winding and situated in the center of the winding, and a circuit-breaking contact disposed ahead of the coil relative to said cup within the magnetic field produced thereby and electrically connected to said core. Special means must be provided to prevent the coil from exploding under the effect of a short circuit current when the switch is opened.

The invention seeks to provide means which are simple and easy to implement for imparting a high degree of mechanical strength to the winding of the coil. These means incidentally make it possible to establish electrical contact with each of the ends of the winding in a manner which is both simple and reliable.

SUMMARY OF THE INVENTION

According to the invention, the winding is constituted by means of a flat conductor which is wound in a plurality of turns on the core together with an insulating sheet, and means are provided for putting said winding under radial compression.

To this end, in a specific embodiment, the core is provided with an axial slot in which a key is inserted. The conductor of the winding begins with a portion which is inserted in the slot of the core and which is clamped between said slot and the key, thereby also electrically connecting the winding to the core.

The insulating sheet is made of glass fiber impregnated with hardenable resin in order to withstand pressure.

Further, the winding is surrounded by a split ring. The conductor of the winding extends without the insulation through the split in the split ring and is wound thereabout. The winding and its split ring are compressed inside the cup in order to confer a high degree of mechanical strength to the assembly. Further, the winding is also electrically connected to the cup.

In addition, the conducting cup contains an inside cup of steel, and the core is also made of steel. This serves to provide both a low reluctance magnetic circuit for the coil and strong component parts for putting the winding under compression.

Finally, the core is fixed to the base of the cup by a screw with insulation being provided where it passes through the cup. An arc run is formed on a conducting disk which is carried by the core and which is electrically and mechanically connected to the core by the screw.

BRIEF DESCRIPTION OF THE DRAWINGS

An embodiment of the invention is described by way of example with reference to the accompanying drawings, in which.

MORE DETAILED DESCRIPTION

Figure 1:
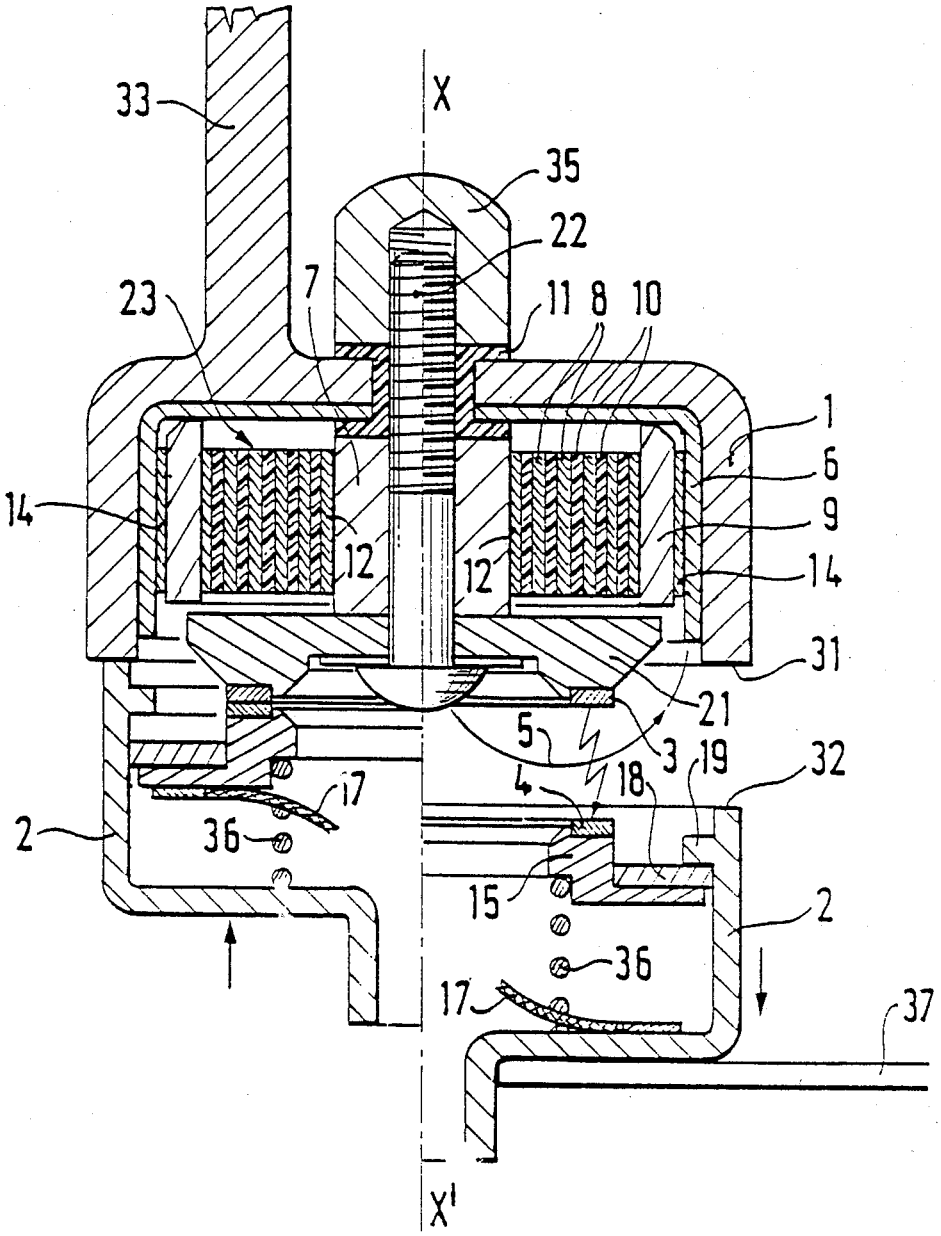
FIG. 1 is an axial section through a contact element of a circuit breaker in which the present invention is applied.

The FIG. 1 contact element is shown in section on its axis X-X' and has generally circular symmetry. It is disposed in a medium tension switch such as a circuit breaker. This apparatus comprises an enclosure filled with a dielectric gas such as sulfur hexafluoride, and containing means for supporting the fixed portion of the contact element, together with means for moving and guiding the moving portion of the contact element. These means are well-known in the art and are therefore not described.

The description begins with the fixed portion of the contact element which comprises, going from the outside towards the inside: a cup 1 made of a conducting metal such as copper and including a connection electrode 33; an inside cup 6 made of a magnetizable metal such as steel; a ring 9 made of malleable metal such as aluminum; a winding 23 comprising a conducting strip 8 made of copper foil wound together with an insulating strip 10, e.g. made of glass fiber reinforced polyester resin; a core 7 made of magnetizable metal such as steel; and a fixing screw 22 which is likewise made of steel.

The outer end 14 of the conducting strip 8 is in electrical contact with the cup 1. Its inner end 12 is in electrical contact with the core 7 which is also a conductor of electricity. An insulating sleeve 11 electrically isolates the screw 22 and the core 7 from the cup 1. A nut 35 is screwed onto the end of the screw 22. The nut bears against the insulating sleeve 11.

A disk 21 is fixed to the core 7 by means of the screw 22, said disk being a conductor of electricity, e.g. being made of copper or a copper-chronium alloy, and it has an arc run 3 provided thereon made of tungsten or of copper-tungsten alloy. The free surface of the arc run is ahead of the circular edge 31 of the cup 1.

The moving portion of the contact element is shown in its closed position to the left of the axis X-X', and in its open position to the right of said axis. It comprises a moving cup 2 made of a conductive metal such as copper including an internal abutment 19 and terminated by a circular edge 32 which is intended to bear against the edge 31 of the fixed cup 1. The moving cup contains a moving circuit-breaking contact which is urged outwardly by a compression spring. The circuit-breaking contact comprises a friction ring 18, a moving disk 15 surrounded by the friction ring 18, and an arc run 4 similar to and facing the arc run 3. A flexible conductor 17 connects the moving circuit-breaking contact to the base of the cup 2. An electrode 37 is connected to the outside of the cup 2.

In the closed position (to the left of the axis X-X'), the moving and fixed cups are in electrical contact via their respective edges 31 and 32, thereby establishing a low resistance main current path between the electrodes 33 and 37, thus short-circuiting the coil and the circuit-breaking contact.

In the open position (to the right of the axis), the contacts are open and the electrodes 33 and 34 are isolated from each other.

In order to go from the closed position to the open position, the mechanism of the circuit breaker (not shown) pulls the moving cup 2 downwardly. Initially the circuit-breaking contact remains closed while the moving cup 2 moves away from the fixed cup 1. A current is therefore set up between the electrodes 33 and 37 via the moving cup 1, the internal cup 6, the winding 23, the core 7, the disk 21, the arc runs 3 and 4 which are still in contact with each other, the moving disk 15, the conductor 17, the moving cup 2, and the electrode 37.

The spring 36 extends progressively until the ring 18 abuts against the abutment 19. At this moment the disk 15 moves away from the disk 21. An arc is struck between these two disks. The arc maintains the current flowing through the winding 23 of the coil. This generates a magnetic field running round the inside cup 6, the core 7 and the screw 22, and looped at 5 in the form of a radial field which includes a component that is perpendicular to the arc struck between the runs 3 an 4. As is well known, this causes the arc to rotate along the runs 3 and 4 and contributes to extinguishing it, until the runs 3 and 4 have moved far enough apart from each other to ensure that any current is interrupted.

Figure 2:
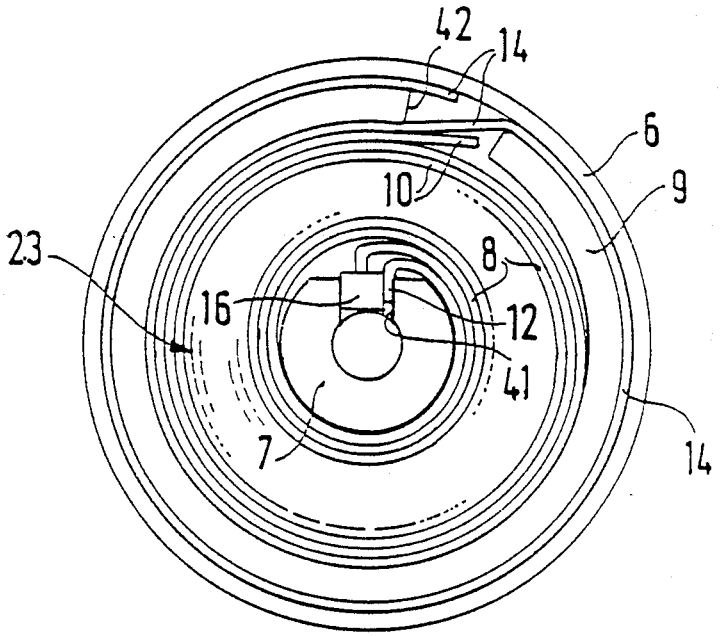
FIG. 2 is a view of the coil in the FIG. 1 contact element as seen from below.

Considerable electrodynamic forces must be withstood by the coil during the time that it conveys a short circuit current. In order to ensure that the coil withstands these forces without being damaged, it is constructed, in accordance with the invention, in a manner which is examined in greater detail with reference to FIG. 2.

In this figure which is a view as seen from below of the magnetic cup 6, the winding, the ring 9, and the core 7, it can be seen that the core 7 has a wide slot 41 into which the non-insulated inside end 12 of the winding conductor 8 is engaged together with a wedge-shaped key 16. Externally, the winding is surrounded by a ring 9 which is split at 42, with the end 14 of the conductor 8 passing through the split so as to pass over the ring and perform an almost complete turn thereover. The ring and winding assembly is compressed inside the cup 6.

To do this, the end 12 of the conductor 8 is placed in the slot 41, the key 16 is put into place, and then the conductor 8 and the insulating sheet 10 are wound under tension around the core 7 while the screw 22 is omitted. The ring 9 is then put into place. The assembly is inserted into the cup 6 under force from a press which presses against the base of the cup 6 and against the ring 9. The ring bears against the cup and is copressed, so as to be plastically deformed, and in turn it compresses both the end 14 of the conductor 8 against the cup 6 and the winding 23 against the core 7. The end 14 of the conductor 8 is thus electrically connected to the cup 6. The end 12 of the conductor 8 is crushed against the slot 41 and is put into electrical contact with the core 7.

The radial compression obtained in this way, in conjunction with the friction characteristics of the insulating sheet, serves to achieve mechanical strength for the winding enabling it to withstand, without deformation, the electrodynamic forces which are caused by a very high current being set up in the coil.

Naturally the above description is given purely by way of non-limiting example and numerous variants may be devised without going beyond the scope of the invention.

We claim:

1. An arc-rotating magnetic blast coil for the contact element of an electric switch, the coil comprising, in particular, a conducting cup which is cylindrical in shape and which is connected to a current inlet, a winding disposed inside the cup to produce a magnetic field along the axis of the cup and having one end connected to the cup, a conducting core connected to the other end of the winding and situated in the center of the winding, and a fixed circuit-breaking contact disposed ahead of the coil relative to said cup within the magnetic field produced thereby and electrically connected to said core, wherein the winding is constituted by means of a flat conductor comprising a plurality of turns wound on the core together with an insulating sheet, and wherein means are provided for putting the winding under compression.

2. A magnetic blast coil according to claim 1, wherein the core is provided with an axial slot in which a key is inserted for the purpose of electrically connecting the end of the conductor to the core.

3. A magnetic blast coil according to claim 2, wherein the conductor of the winding begins with a non-insulated portion inserted into the slot of the core and clamped between the core and the key, thereby electrically connecting the winding to the core.

4. A magnetic blast coil according to claim 1, wherein the insulating sheet is made of glass fiber impregnated with a hardenable resin.

5. A magnetic blast coil according to claim 1, wherein the winding is surrounded by a split ring.

6. A magnetic blast coil according to claim 5, wherein the conductor of the winding extends, without insulation, through the split in the split ring and is wound over the split ring.

7. A magnetic blast coil according to claim 5, wherein the winding and its ring are compressed inside said cup.

8. A magnetic blast coil according to claim 1, wherein said conducting cup includes an internal magnetic cup.

9. A magnetic blast coil according to claim 7, wherein the core is made of steel.

10. A magnetic blast coil according to claim 9, wherein the core is fixed to the base of the cup by means of a screw with insulation being provided where the screw passes through the cup.

11. A magnetic blast coil according to claim 10, wherein said circuit-breaking contact comprises a conducting disk carried by the core and electrically and mechanically connected to the core by the screw.

* * * * *